US006978508B2

(12) United States Patent
Young

(10) Patent No.: US 6,978,508 B2
(45) Date of Patent: Dec. 27, 2005

(54) DISPOSABLE CLEANING FABRICS

(75) Inventor: Ronald Scot Young, St. Joseph, MO (US)

(73) Assignee: Scot Young Research, Inc. (GB)

( * ) Notice: Subject to any disclaimer, the term of this patent is extended or adjusted under 35 U.S.C. 154(b) by 0 days.

(21) Appl. No.: 09/844,803

(22) Filed: Apr. 27, 2001

(65) Prior Publication Data

US 2001/0052162 A1 Dec. 20, 2001

Related U.S. Application Data

(63) Continuation-in-part of application No. 09/593,999, filed on Jun. 14, 2000.

(51) Int. Cl.[7] ..... A47L 13/20
(52) U.S. Cl. ..... 15/229.2; 15/229.1; 15/228
(58) Field of Search ..... 15/228, 229.1, 15/229.2

(56) References Cited

U.S. PATENT DOCUMENTS 4,923,738 A * 5/1990 Newell
4,995,133 A * 2/1991 Newell
5,066,527 A 11/1991 Newell
6,212,729 B1 * 4/2001 Weichelt

* cited by examiner

*Primary Examiner*—Randall E. Chin
(74) *Attorney, Agent, or Firm*—Wm Bruce Day

(57) ABSTRACT

Disposable and semi-disposable cleaning devices use lengths of folded and nonfolded non-woven fiber material interlaid with paper or waste fabric strips or ribbons or any other type of material. These fabrics are an alternative to yarn in the manufacture of inexpensive, disposable and semi-disposable products including mopheads, mats, drop sheets, furniture covers for movers, carpet protectors, cleaning wipes, mopheads, diapers, incontinence mats and the like. A particular embodiment is disclosed wherein a mop swab is made from the disclosed yarn substitute to provide a mop which is priced to discard after one time or several times use depending upon the type of material used in the construction process. The mop swab is formed from the elongate yarn substitute by wrapping about spaced arms and bunched to form a head attachable to a mop fixture. Tail ends may be looped or cut. Wipes may be made from the yarn substitute by forming a wrap and placing the wrap within a case-like cover.

2 Claims, 3 Drawing Sheets

Fig. 1
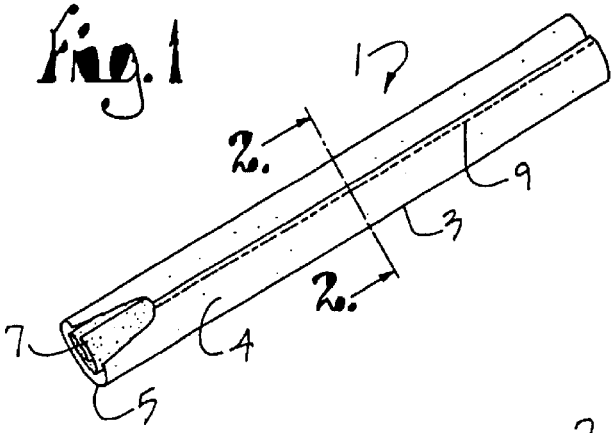
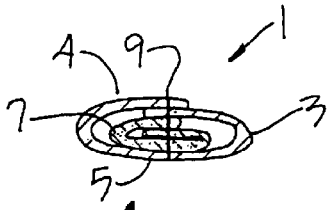
Fig. 2
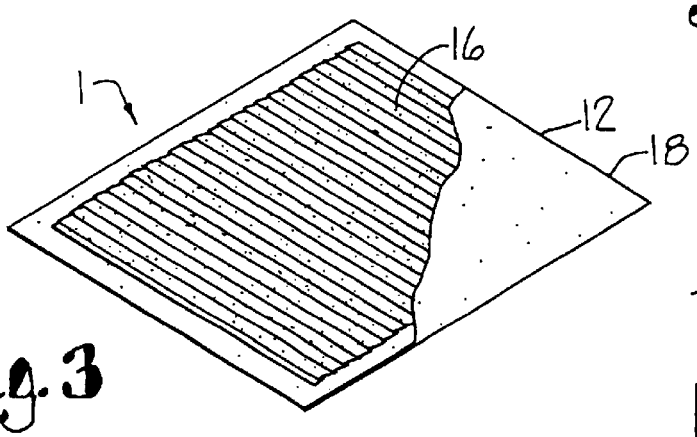
Fig. 3
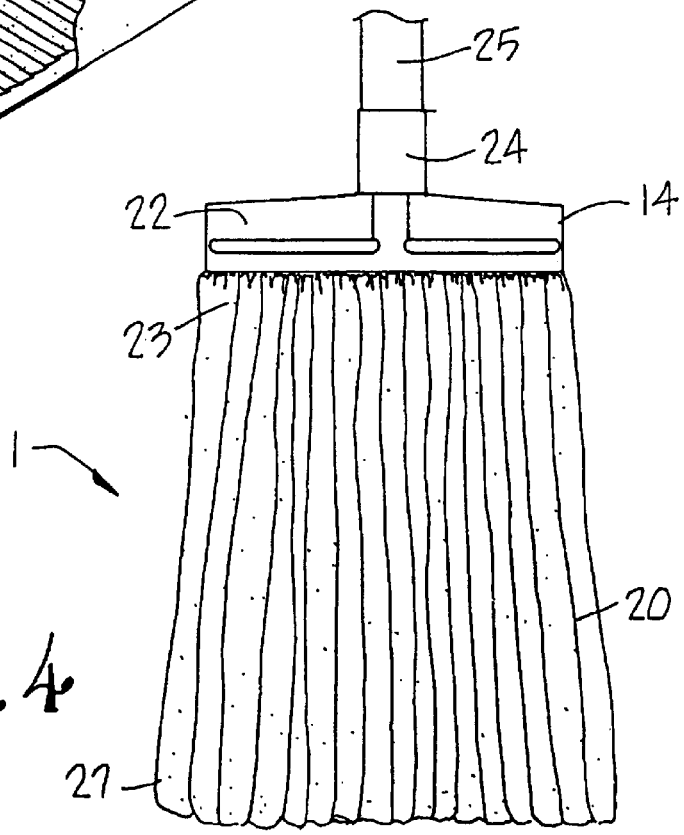
Fig. 4

DISPOSABLE CLEANING FABRICS

RELATED APPLICATION

This is a continuation in part of application Ser. No. 09/593,999, filed Jun. 14, 2000 now pending.

FIELD OF THE INVENTION

This invention relates to cleaning fabrics and materials and a method for making same which uses inexpensive, generally waste materials. The fabrics are preferably made from non-woven fiber materials with an outer layer of material and a highly absorbent inner layer of material.

BACKGROUND OF THE INVENTION

Cleaning devices, mops, wipes and covers have historically been made from cotton or synthetic fibers which are twisted and formed into strands and the strands formed into yarns. The yarns may be woven on looms to product sheet form goods. These woven fabric articles are made in more or less degrees of cost. An alternative to traditional fiber yarns has been the use of non-woven cellulose/wood pulp fabrics such as used in tea bags, food and industry machine filters, disposable uniforms, packaging, paper wipes, facial tissue, paper towels and the like. Waste products result from the manufacture of these items. Applicant's invention provides a novel approach to the use of these waste products. An outer strip of inexpensive or waste material is combined with an inner filling of a different type of waste material. The inner and outer materials are combined by a multiplicity of folds or by tacking, stitching, gluing or other connection means. These waste materials are based on various components mixed with preferably cellulose based non-woven materials which are selected for particular end uses on the basis of differing performance characteristics such as resistance to abrasion, absorbency, longevity and abrasive qualities. The extreme low cost of these materials, previously considered waste trimming and lower end by-products of higher end manufacturing processes, makes feasible a one time or very short time or limited time use for the ultimate purchaser while maintaining an adequate margin for the manufacturer.

Many attempts have been made to produce an inexpensive mop which have met varying degrees of success. Some methods have used the cheapest fibers or re-claimed fibers in the spinning process, others have used stacks of fabrics from which strips are cut to form flat ribbons or strings, and yet others have processed non-woven materials using special stretching and twisting techniques which reduce absorbency but add sufficient strength to make a usable mop or other cleaning article. Some are less or more absorbent than others, and some are sturdier in use than others. The instant invention presents a novel solution to the disposable cleaning article and mop problem by providing a strip or ribbon of material which is folded about an absorbent inner material. A mop made in accordance with the disclosed process is of such low expense that it can be disposed after a limited time which may vary from a single day to several weeks. The mop is absorbent yet sufficiently robust to provide effective scrubbing and cleaning ability. Throws, absorbent pads and wipes can also be made from the disclosed yarn substitute; a particular form of wipe is disclosed.

DESCRIPTION OF THE DRAWINGS

The following drawings are provided as illustrative examples of the present invention. FIG. 1 is a perspective, fragmentary view of a yarn substitute textile material embodying the present invention.

FIG. 2 is a cross-sectional view taken along the lines 2—2, FIG. 1.

FIG. 3 is a perspective, fragmentary view of the yarn substitute material embodied so as to form a wipe or mat.

FIG. 4 is a front elevational view of the yarn substitute embodied in the form of a mop.

DESCRIPTION OF THE PREFERRED AND ALTERNATE EMBODIMENTS

Figure 5:
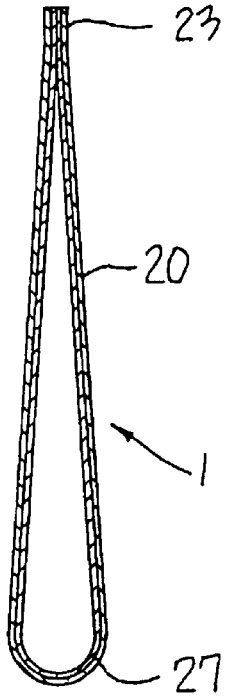
FIG. 5 is an enlarged, cross-sectional view of the mop.

As required, a detailed description of the preferred and alternate embodiments is disclosed herein, however, other embodiments or configurations may be apparent based upon the following description to those having ordinary skill in the art.

Ref. 1, FIG. 1 generally designates a ribbon forming a yarn substitute. The ribbon 1 is generally formed of an outer wrapping 3 of a non-woven material such as used in the manufacture of tea bags, food and industry machine filters, disposable uniforms, packaging, and the like. The outer wrapping 3 is a waste material remaining from the manufacturer of such items and are the trimmings or ends of rolls of such material. This scrap material differs in resistance to abrasion, absorbency, longevity, abrasive qualities and other attributes. Because the ribbon 1 can be put to various purposes as a yarn substitute, the qualities of the outer wrapping 3 are selected based upon the proposed use of the ribbon 1. The outer ribbon 3 is preferably a single length of material which is folded double, as shown in FIG. 2, into top and bottom layers 4 and 5. The ribbon 1 is filled with other non-woven fabric waste products such as trimmings from paper wipes, facial tissue, paper towels and the like highly absorbent materials. This filling 7 is also folded longitudinally, may be folded in multiple pleats accordion style and is gathered within the outer wrapping 3, FIG. 2. The complete ribbon 1 is preferably in the order of one quarter inch to one inch wide, and is manufactured in long rolls.

To secure the outer wrapping 3, the wrapping 3 may be center stitched 9, as shown in FIGS. 1 and 2, or the stitching 9 may be edge stitching. Other types of bonding may be used as appropriate, including ultrasonic welding, heat welding, gluing, and other closure techniques. Alternatively, stitching 9 may not be required at all and the wrapping 3 would be sufficiently wrapped about the inner filling 7 to provide a complete closure which will remain intact.

The ribbon 1 is useful for making inexpensive, disposable sanitary maintenance items such as the wipe or pad 12 shown in FIG. 3 or the mop 14 shown in FIG. 4. In the wipe or pad 12, FIG. 3, the ribbon 1 is formed into a flat mat structure 16 as by winding a continuous length of ribbon 1 about spaced arms which use chains or augers as is commonly known in the art to produce a coil of material. The distance between the spaced arms is dependent upon the width of the article to be produced. In the illustrated mat structure 16, the width may be several inches or several feet depending on the size of wipe or pad to be used. If a wipe, then five or six inches wide may be appropriate. If a pad, such as to be placed by the bedside of an incontinent person, or, for example, used for oil spills, or as a packaging protective pad, the structure might be several feet wide. The mat structure 16 is encased within a pillow or envelope 18 with top and bottom layers sealed closed.

When used in the manufacture of a mop 14, the ribbon 1 is formed into a mophead 20 by coiling about the aforementioned spaced traveling arms with the resultant spiral wound structure cut to a headband width of approximately six inches. A mop fixture 22 is affixed at the head 23. The mop fixture 22 includes a spigot 24 for connection to a mop handle 25. The tail end 27 of the mop, FIG. 4, is left looped, one arm of the mop shown in connection with FIG. 5, another arm of which would extend parallel to the one arm shown in FIG. 5 in a true longitudinal sectional view of FIG. 4. Note that the ribbon 1 is left looped at the tail end 27. When a looped end mop is constructed, no stitching 9 need be done and the outer wrapping 3 may be simply folded over and retained in place by the looped end. However, if it is desired to construct a cut end mop (not shown), then it is desired to use appropriate stitching 9 or other edge connection or bonding technique.

Figure 6:
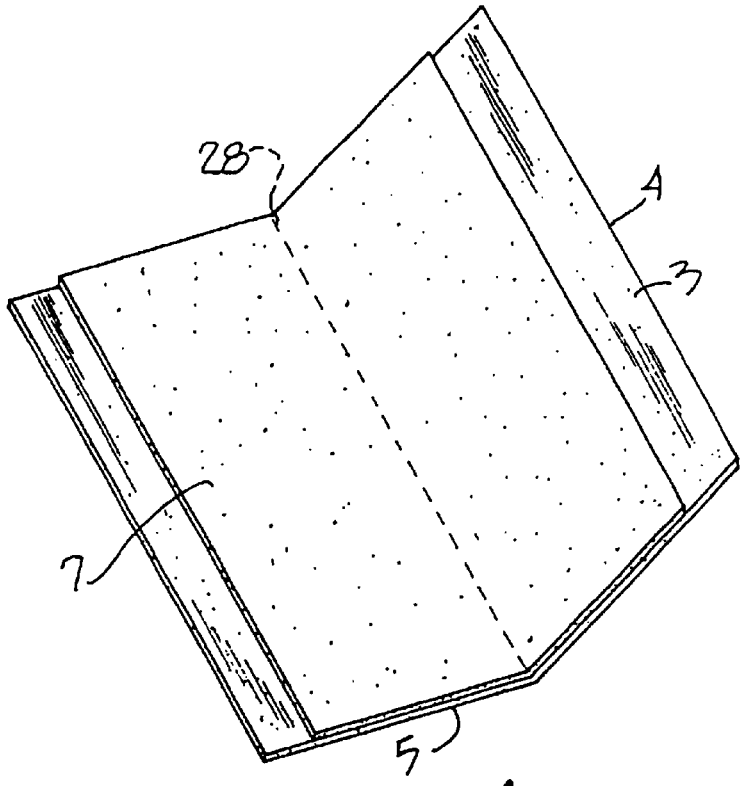
FIG. 6 discloses a step in the manufacture of the yarn substitute ribbon shown in FIG. 1.
Figure 7:
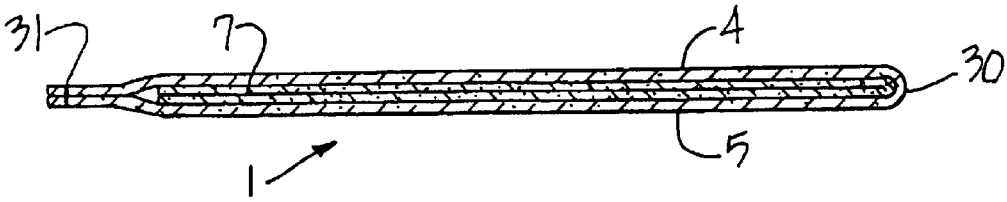
FIG. 7 is a cross-sectional view of the ribbon structure shown in FIG. 6.
Figure 8:
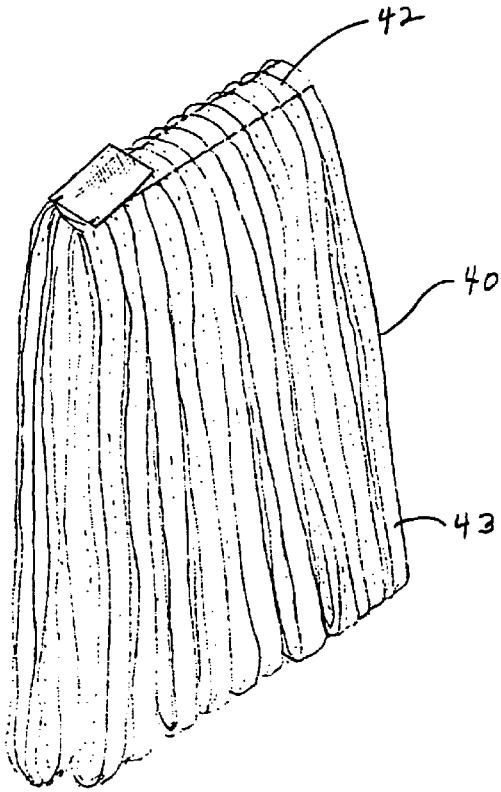
FIG. 8 is a perspective view of an alternative embodiment mop.

A method of manufacture of the ribbon 1 is shown in connection with FIGS. 6 and 7, wherein the wrapping 3 is run through rollers which form a trough 28, the inner filling 7 laid into the bottom layer 5 and the top layer 4 folded thereover. FIG. 7 shows a folded edge 30 and an opposite stitched edge 31.

The ribbon 1 may be manufactured in various widths, but the preferred ribbon particularly suitable as a yarn substitute is in the nature of a half-quarter to one-inch in width.

The aforementioned yarn substitute provides an inexpensive alternative to cotton-based twisted yarn products. Such yarn products, when made inexpensively, use short length fibers which are susceptible to linting off of the yarn strand and further subject to rapid deterioration. The alternative disclosed herein uses interlaid lengths of folded and non-folded non-woven and cellulose and paper strips or ribbons to make a mop, wipe, pad or other such sanitary maintenance product of such low cost that it is economically disposable. It will be appreciated that folded material has been shown herein, however, if long strips of edge cut material are available, non-folded single strips may be readily used, particularly when laid in in a stacked or sandwich manner as filling.

The waste inner material originates from such products as tea bags, food and industry machine filters, disposable uniforms, packaging, paper wipes, facial tissue, paper towels, and the like. Each specific waste product has different physical properties such as high absorbency, heat retention, and the like which can be suited to various applications. The outer material or wrapper can be selected to have differing physical properties to suit specific applications, including high tensile strength, waterproofness, cleaning power, dirt retention or release, non linting, oil and grease adherence, and the like. Various types of non-woven material from edge trimming waste suitable for use in the present invention range in weight from 18 to 60 grams per sq. meter. Suitable materials range from 20 to 50% polypropylene or viscose and up to 10% cotton. The non-woven types of material suitable for use include spun lace, hydro entangled, thermal bonded and print bonded.

Figure 9:
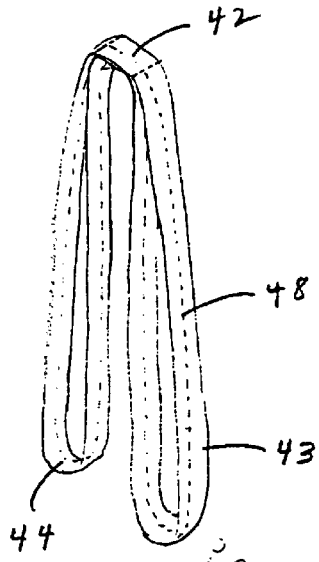
FIG. 9 is a fragmentary view of the mop shown in FIG. 8.

A particular embodiment of a mop made in accordance with the present invention is shown in connection with FIGS. 8–11. A mop 40 is of the closed end, or double-looped end variety with a headband 42. The mop 40 would normally be attached to a mop holding fixture (not shown) at the headband 42. The mop 40 is composed of the previously mentioned ribbon form strands 43 of a fabric material heretofore generally considered waste or of only minimal value. FIG. 9 shows that the strands 43 form opposite looped ends 44 on each side of the headband 42. FIG. 9 shows a single opposite side of the headband 42. FIG. 9 shows a single opposite side strand 43 from the mop 40.

Figure 10:
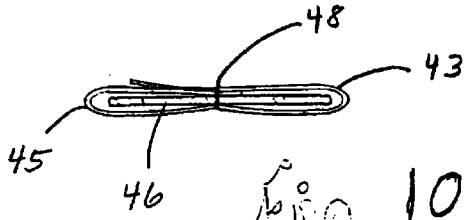
FIG. 10 is a cross-sectional view of a mop strand of the mop shown in FIG. 8.
Figure 11:
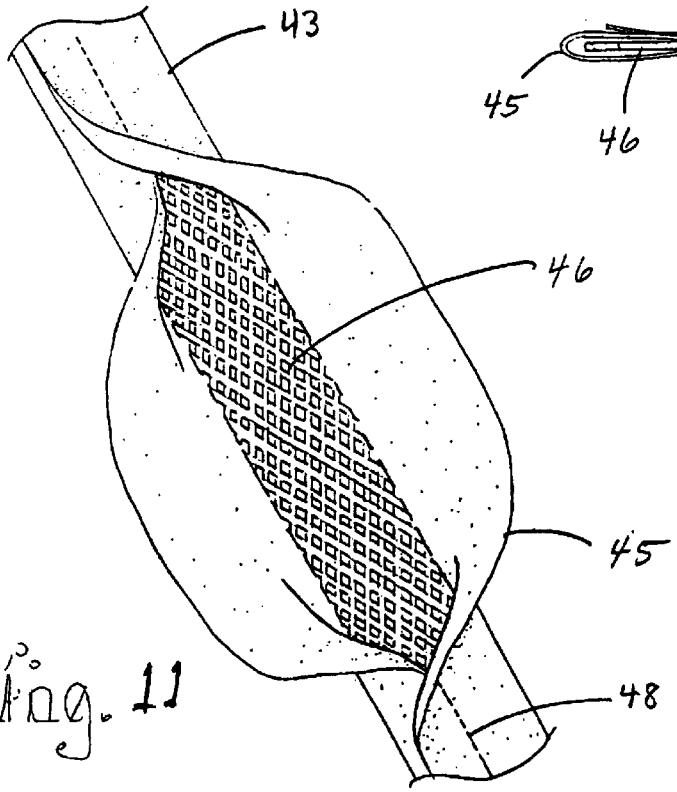
FIG. 11 is a perspective view of an individual mop strand from the FIG. 8 mop.

FIG. 10 shows the strand 43 in cross-section and illustrates that each strand 43 is formed of an outer wrapper 45 folded longitudinally about in filling strip 46. The outer wrapper 45 is of a non-woven porous material and the filling strip 46 of a fine mesh non-woven fabric as shown. A simple layer of the strip 46 forms the core of the strand 43 and the wrapper 45 turns around the core strip 46 so as to cover it, FIG. 10. The wrapper 45 is pulled open in FIG. 11 for purposes of illustration. A center line of stitches 48 holds the assembly together.

This combination provides an effective and low cost mop which lasts at least several times before disposal. These mops are intended to be disposable-they are used several times and then thrown away. The cost is sufficiently low to make disposal cost-effective. With particular care, and using more durable materials there is no reason why the mops could not last longer.

The invention as described above is not limited to the foregoing description except as set forth in the following claims.

What is claimed and desired to be secured by Letters Patent is:

1. A mop swab of elongated ribbons, the ribbons formed from a wrapper of non-woven material at least folded double along the ribbons longitudinal axes and filled with at least one strip of an absorbent mesh material, said ribbons having a center area for binding to a mop handle fixture and having opposite looped ends forming respective tails of said mop swab.

2. The mop swab set forth in claim 1 wherein said ribbons have a line of stitching to hold said wrapper around said strip.

* * * * *